US009586115B1

(12) United States Patent
McGinnis et al.

(10) Patent No.: US 9,586,115 B1
(45) Date of Patent: Mar. 7, 2017

(54) 3D GAME

(75) Inventors: Michael McGinnis, Santa Rosa, CA (US); Dan Klitsner, Larkspur, CA (US)

(73) Assignee: KID GROUP, LLC, San Francisco, CA (US)

( * ) Notice: Subject to any disclaimer, the term of this patent is extended or adjusted under 35 U.S.C. 154(b) by 660 days.

(21) Appl. No.: 13/589,883

(22) Filed: Aug. 20, 2012

Related U.S. Application Data

(60) Provisional application No. 61/525,109, filed on Aug. 18, 2011.

(51) Int. Cl.
*A63B 67/14* (2006.01)

(52) U.S. Cl.
CPC ..... *A63B 67/14* (2013.01)

(58) Field of Classification Search
CPC ..... A63B 67/14
USPC ..... 273/109
See application file for complete search history.

(56) References Cited

U.S. PATENT DOCUMENTS 3,572,703 A * 3/1971 Greene ..... 273/448
3,787,054 A * 1/1974 Stafford ..... 273/109
3,889,953 A * 6/1975 Grasham ..... 273/271
4,005,865 A * 2/1977 Kidder ..... 273/109
4,008,895 A * 2/1977 Reiner et al. ..... 273/113
4,421,317 A * 12/1983 Hector et al. ..... 463/32
4,422,644 A * 12/1983 Holahan et al. ..... 273/249
4,545,577 A * 10/1985 Randleman ..... 273/113
4,553,754 A * 11/1985 Wiggs et al. ..... 273/153 S
4,657,255 A * 4/1987 Seres ..... A63F 7/305 273/111
4,861,036 A * 8/1989 Watanabe ..... 273/113
5,013,043 A * 5/1991 Halliday ..... 273/258
5,212,874 A * 5/1993 Anderson et al. ..... 33/21.2
D345,383 S 3/1994 Lehoux
5,494,292 A 2/1996 Mileti
5,506,605 A * 4/1996 Paley ..... 345/163
5,564,701 A * 10/1996 Dettor ..... 463/16
5,803,458 A 9/1998 Snyder
5,853,326 A * 12/1998 Goto et al. ..... 463/37
6,099,411 A * 8/2000 Van Wagenen ..... 472/136
6,139,015 A * 10/2000 Hsieh ..... 273/153 R (Continued)

OTHER PUBLICATIONS

Notice of Allowance dated Apr. 3, 2012, U.S. Appl. No. 29/389,395, filed: Apr. 11, 2011, 6 pages.

(Continued)

*Primary Examiner* — Aarti B Berdichevsky
*Assistant Examiner* — Dolores Collins
(74) *Attorney, Agent, or Firm* — Haverstock & Owens LLP

(57) ABSTRACT

Embodiments of the present invention are directed to a three-dimensional game. In some embodiments, the three-dimensional game is a maze game where a player maneuvers at least one ball around tracks and barriers disposed within an enclosure. The player is able to select which track they would like to attempt, and then work with gravity and carefully shift, flip, turn and twist the enclosure to guide the ball. In some embodiments, the enclosure includes a first portion and a second portion. A handle is externally coupled to each portion of the enclosure to manipulate parts of the three-dimensional game to create new pathways, to align pathways enabling completion, or both. A current game state can be preserved by resting the three-dimensional game on a pedestal configured to receive the enclosure.

20 Claims, 16 Drawing Sheets

(56) References Cited

U.S. PATENT DOCUMENTS

| | | | | |
|---|---|---|---|---|
| 6,309,306 | B1 | 10/2001 | Geagley et al. | |
| 6,581,933 | B1 * | 6/2003 | Zivan | 273/241 |
| 6,634,949 | B1 | 10/2003 | Briggs et al. | |
| 7,255,624 | B2 * | 8/2007 | Daftari | 446/92 |
| 7,338,045 | B2 * | 3/2008 | Guha | 273/153 R |
| D613,330 | S | 4/2010 | Ho et al. | |
| 7,749,089 | B1 | 7/2010 | Briggs et al. | |
| 8,011,662 | B2 * | 9/2011 | Black | 273/153 R |
| D662,147 | S * | 6/2012 | McGinnis et al. | D21/300 |
| D662,993 | S * | 7/2012 | McGinnis et al. | D21/300 |
| 8,267,767 | B2 * | 9/2012 | Kryuchkov et al. | 463/20 |

OTHER PUBLICATIONS

Notice of Allowance dated Apr. 2, 2012, U.S. Appl. No. 29/390,560, filed: Apr. 26, 2011, 6 pages.

* cited by examiner

3D GAME

RELATED APPLICATIONS

This application claims benefit of priority under 35 U.S.C. section 119(e) of the U.S. Provisional Patent Application Ser. No. 61/525,109 filed Aug. 18, 2011, entitled "3D Game," which is hereby incorporated by reference in its entirety.

FIELD OF THE INVENTION

The present invention is related to the field of gaming. More specifically, the present invention relates to a three-dimensional game.

BACKGROUND OF THE INVENTION

Traditional mazes typically have a flat-surface and include only one path. Although a traditional maze provides challenge and enjoyment to players, new maze games that provide a three-dimensional experience are desired.

SUMMARY OF THE INVENTION

Embodiments of the present invention are directed to a three-dimensional game. In some embodiments, the three-dimensional game is a maze game where a player maneuvers at least one ball around tracks and barriers disposed within an enclosure. The player is able to select which track they would like to attempt, and then work with gravity and carefully shift, flip, turn and twist the enclosure to guide the ball. In some embodiments, the enclosure includes a first portion and a second portion. A handle is externally coupled to each portion of the enclosure to manipulate parts of the three-dimensional game to create new pathways, to align pathways enabling completion, or both. A current game state can be preserved by resting the three-dimensional game on a pedestal configured to receive the enclosure. Players can race each other or the clock. The three-dimensional game of the present invention is not only entertaining but is also an educational toy and assists in child development. The three dimensional game of the present invention advantageously allows children to exercise their motor and dexterity skills and improve their hand-eye coordination and spatial relations.

In one aspect, a game includes a housing, a three-dimensional structure mounted within the housing, and at least one ball. Typically, a player during game play continuously moves the game to orient gravity to the at least one ball such that at least one ball moves through the three-dimensional structure. The housing typically includes a first portion and a second portion. The three-dimensional structure typically includes a path when the three-dimensional structure is manipulated by the player to be in a first configuration and includes a different path when the three-dimensional structure is manipulated by the player to be in a second configuration. In some embodiments, a first handle is coupled with the first portion and a second handle is coupled with the second portion. Each of the first handle and the second handle is configured to manipulate at least a part of the three-dimensional structure.

In some embodiments, the game includes one or more external controllers coupled the housing. Each external controller is configured to manipulate at least a part of the three-dimensional structure. In some embodiments, the one or more external controllers includes the first handle and the second handle. The one or more external controllers provide twisting actions, non-twisting action, or both. The twisting actions include rotating a plurality of tracks concurrently and rotating a single track. The non-twisting actions include squeezing, pulling, pressing and sliding at least a portion of the one or more external controllers.

In another aspect, a game includes a shell and an internal three-dimensional pathway structure enclosed within the shell. The three-dimensional pathway structure typically includes parts that are externally manipulable to achieve a desired result. A desired result can be to create new pathways, to align pathways to enable completion of a game play, or both.

In some embodiments, an internal change to the three-dimensional pathway structure is caused by one or more external manipulations. The parts are manipulated via a rotational action, a twisting action, a squeezing action, a pulling/pushing action, a pressing action, a sliding action, use of magnets, or a combination thereof. In some embodiments, the internal three-dimensional pathway structure includes parts that are non-externally manipulable.

In yet another aspect, a gaming system includes a game. The game typically includes a three-dimensional pathway structure having variable paths and at least one game state. In some embodiments, the at least one game state is achieved by moving the game to thereby orient gravity to an at least one mobile element such that the at least one mobile element moves through the three-dimensional pathway structure. In some embodiments, the at least one mobile device is a ball. The gaming system also includes a pedestal configured to preserve the at least one game state.

In some embodiments, the game includes a plurality of levels. The at least one game state can be saved by locking a corresponding level. In some embodiments, the corresponding level is locked by completing a portion of the game.

In some embodiments, the three-dimensional pathway structure includes parts that are manipulable to achieve the at least one game state. In some embodiments, the three-dimensional pathway structure is a maze. In some embodiments, the variable paths are created when parts of the three-dimensional pathway structure is manipulated

BRIEF DESCRIPTION OF THE DRAWINGS

Reference will now be made in detail to implementations of the present invention as illustrated in the accompanying drawings. The same reference indicators will be used throughout the drawings and the following detailed description to refer to the same or like parts.

DETAILED DESCRIPTION OF THE INVENTION

In the following description, numerous details are set forth for purposes of explanation. However, one of ordinary skill in the art will realize that the invention may be practiced without the use of these specific details. Thus, the present invention is not intended to be limited to the embodiments shown but is to be accorded the widest scope consistent with the principles and features described herein.

Embodiments of the present invention are directed to a three-dimensional game. In some embodiments, the three-dimensional game is a maze game where a player maneuvers at least one ball around tracks and barriers disposed within an enclosure. The player is able to select which track they would like to attempt, and then work with gravity and carefully shift, flip, turn and twist the enclosure to guide the ball. In some embodiments, the enclosure includes a first portion and a second portion. A handle is externally coupled to each portion of the enclosure to manipulate parts of the three-dimensional game to create new pathways, to align pathways enabling completion, or both. A current game state can be preserved by resting the three-dimensional game on a pedestal configured to receive the enclosure. Players can race each other or the clock. The three-dimensional game of the present invention is not only entertaining but is also an educational toy and assists in child development. The three dimensional game of the present invention advantageously allows children to exercise their motor and dexterity skills and improve their hand-eye coordination and spatial relations.

Three-Dimensional Game Overview

Figure 1:
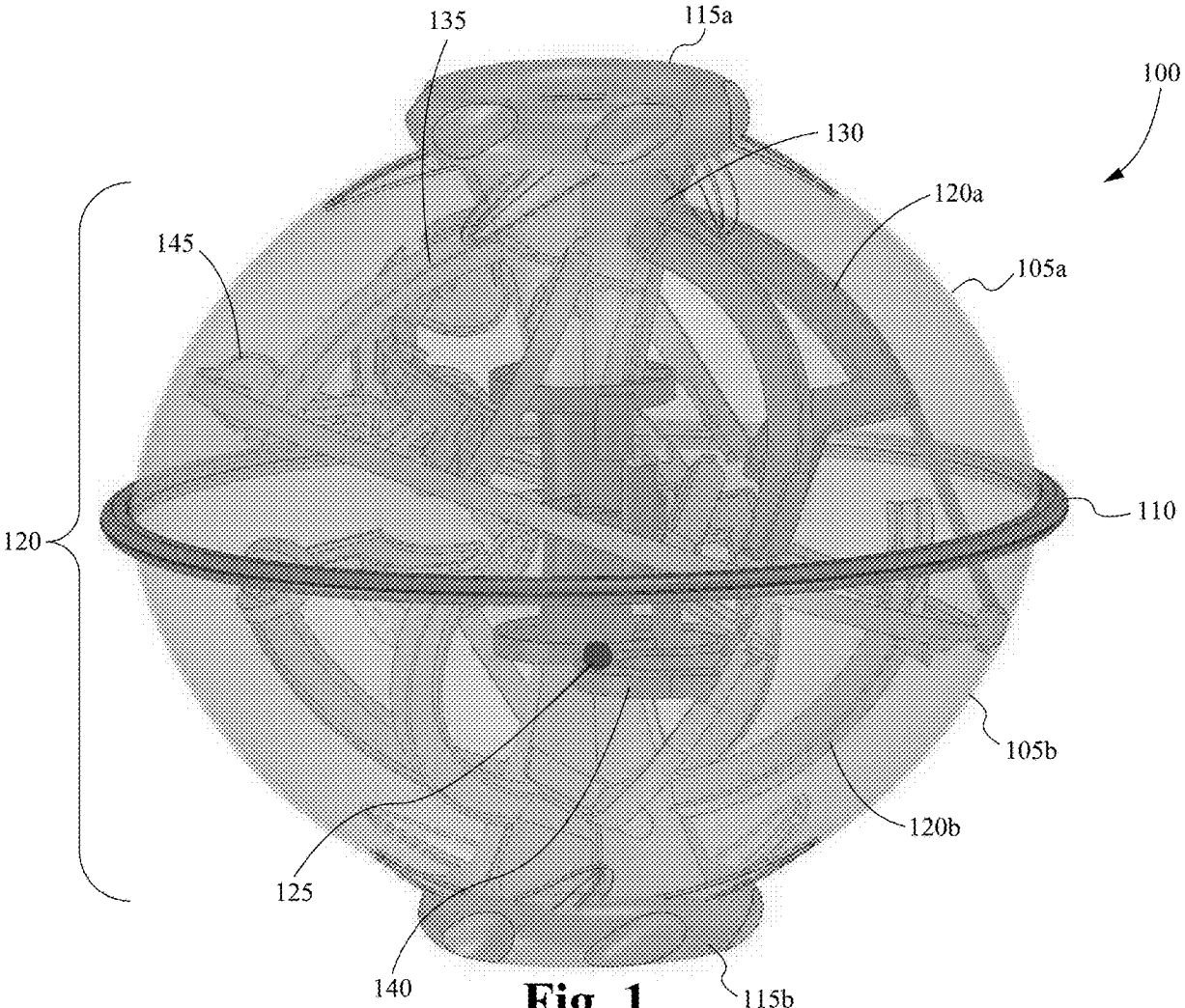
FIG. 1 illustrates an exemplary three-dimensional game in accordance with the present invention.

FIG. 1 illustrates an exemplary three-dimensional game 100 in accordance with the present invention. The three-dimensional game 100 includes a shell 105. The terms orbit, housing, enclosure, container, and the like, are synonymous with the term shell and are used interchangeably herein. The shell can be spherical, cylindrical, cube-shaped, wok-shaped, barrel-shaped, or is of any geometrical shape. The shell is transparent. The shell is typically clear, although the shell can be tinted in one or more colors. The shell 105 includes a first portion 105*a* and a second portion 105*b*. As shown in FIG. 1, the shell 105 is spherical, and the first portion 105*a* is a top half of the shell 105 and the second portion 105*b* is a bottom half of the shell 105. In some embodiments, the first portion 105*a* and the second portion 105*b* are coupled by one or more external rings 110. The shell is made of PETG plastic or other suitable material.

The shell 105 encloses a three-dimensional pathway structure 120. The three-dimensional pathway structure 120 includes a first set of parts 120*a* and a second set of parts 120*b*. Each set of parts 120*a*, 120*b* includes a trunk 130, one or more branches 135 branching from the trunk 130, one or more sub-branches 140, and one or more barriers 145. The trunk 130, the one or more branches 135, the one or more sub-branches 140, and/or the one or more barriers 145 make up the tracks of the three-dimensional pathway structure 120. The tracks 135 can be color coded, numbered or both to assist a player during game play. The terms pathway and path are synonymous with the term track and are used interchangeably herein.

The shell 105 is coupled with at least one external controller 115. As shown in FIG. 1, the three-dimensional game 100 includes two external controllers 115. A first external controller is a first handle 115*a* coupled with the first set of parts 120*a*, and a second external controller is a second handle 115*b* is coupled with the second set of parts 120*b*. Other types of external controllers 115 are discussed elsewhere. Each external controller 115 is configured to manipulate at least a part of the three-dimensional pathway structure 120 from outside the shell 105. The three-dimensional pathway structure 120 can be manipulated to achieve a desired result, including creating new pathways and aligning pathways to enable completion.

The three-dimensional game 100 also includes at least one mobile element 125. In some embodiments, the at least one mobile element 125 includes a ball. The ball 125 can be color coded. Alternatively or in addition to, the ball 125 can be magnetically attractive. During game play, the player continuously moves the three-dimensional game 100 to orient gravity to the ball 125 such that the ball 125 moves through the three-dimensional pathway structure 120, creating at least one game state. Moving through different pathways of the three-dimensional pathway structure 120 is an exercise in spatial reasoning and stimulates cognitive reasoning. As the player moves the ball 125 along a track, the player will find that they have reached a different colored track that requires the player to perform one or more actions, such as but not limited to rotate, flip, twist, and spin, on the three-dimensional game 100 through one, two or all three physical dimensions one way or another to keep the ball 125 rolling. Since new pathways can be created, pathways within the three-dimensional game 100 are variable, keeping the three-dimensional game 100 challenging.

Although not illustrated, the three-dimensional game 100 can also include a built in clock or timer, which allows the player to race against during game play.

Figure 2:
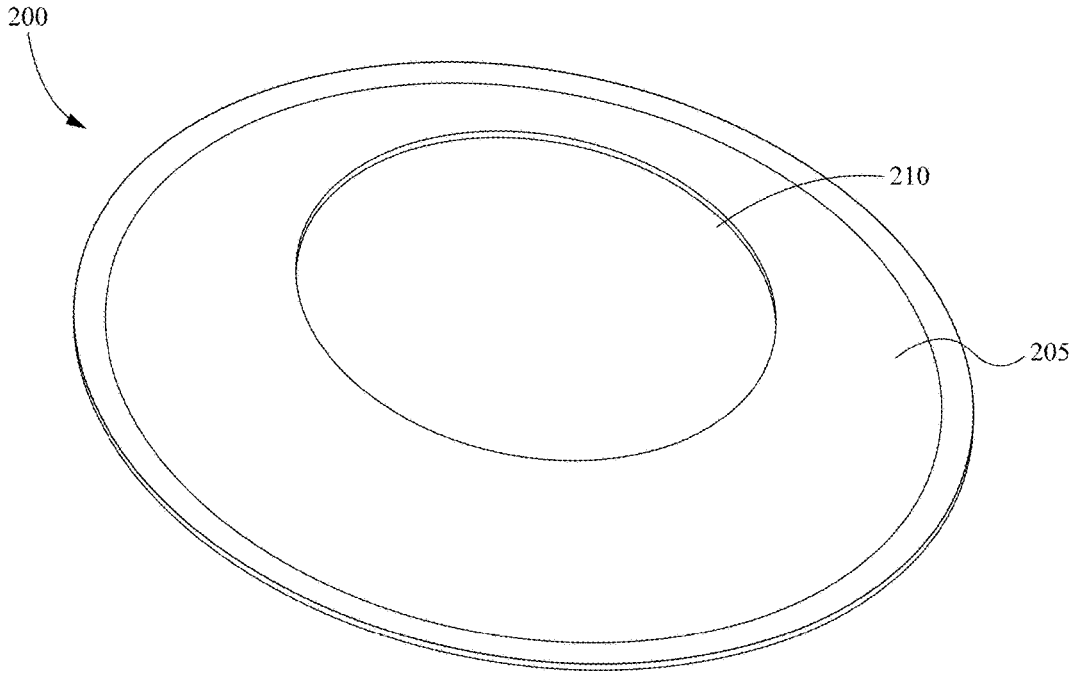
FIG. 2 illustrates an exemplary pedestal in accordance with the present invention.

FIG. 2 illustrates an exemplary pedestal 200 in accordance with the present invention. The pedestal 200 has a cone-shaped or dome-shaped body 205 and an opening 210 at a top for receiving for example a game, such as the three-dimensional game 100. Other shaped bodies are contemplated.

Figure 3:
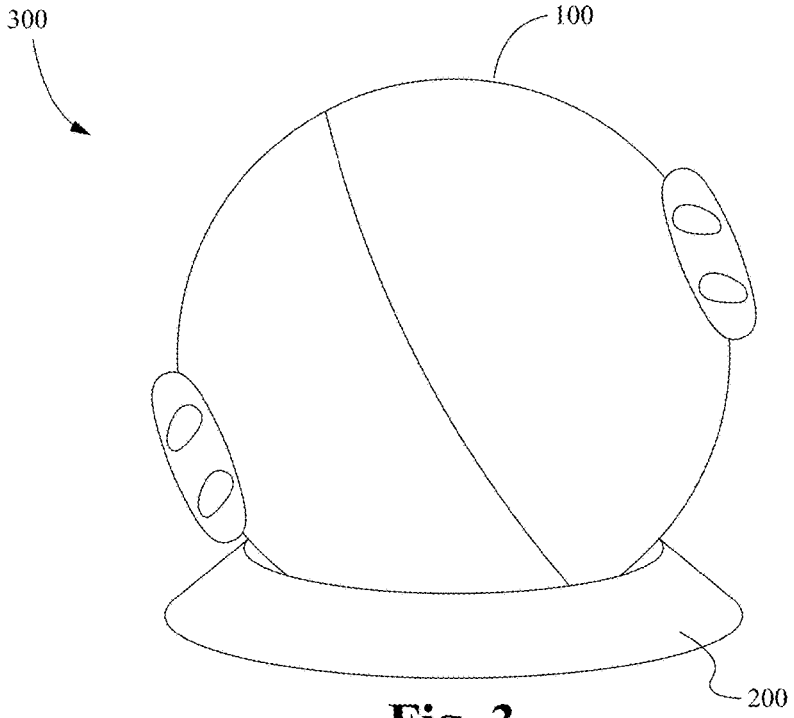
FIG. 3 illustrates an exemplary gaming system in accordance with the present invention.

FIG. 3 illustrates an exemplary gaming system 300 in accordance with the present invention. The gaming system 300 typically includes the three-dimensional game 100 and the pedestal 200. As shown in FIG. 3, the three-dimensional game 100 is coupled to the pedestal 200, which advantageously save a game state during game play. The game state can be any state prior to completion. For example, the player is able to set the three-dimensional game 100 on the pedestal 200 and return to the game afterwards. Alternatively, the game state can be a completion state. For example, the player is able to set the three-dimensional game 100 on the pedestal 200 after completion to show that the player indeed has finished the game. Alternatively, the pedestal can simply be used for storing the three-dimensional game 100.

Manipulating the Three-Dimensional Game

External Manipulations. In some embodiments, parts of the three-dimensional pathway structure 120 can be manipulated from outside the shell 105. Different methods for manipulating the three-dimensional pathway structure 120 include, but are not limited to, a rotational action, a twisting action, a squeezing action, a pulling/pushing action, a pressing action, a sliding action, use of magnets, or a combination thereof.

Rotational Action.

Referring back to FIG. 1, each set of parts 120*a*, 120*b* typically includes six branches 135 that extend from the trunk 130 at extension junctions. More or less branches are contemplated. In some embodiments, a game play can begin at any of the extension junctions by moving the three-dimensional game 100 to position the ball 125 at that extension junction. Each branch from a set of parts is configured to align with one or more branches of the other set of parts by twisting any of the handles 115*a*, 115*b*, which are coupled with the three-dimensional pathway structure 120.

In some embodiments, twisting one or both handles 115*a*, 115*b* rotates the respective portions of the shell 105*a*, 105*b*, which in turn rotates the respective sets of parts 120*a*, 120*b*. For example, assume the player rotates the first handle 115*a* clockwise. Then, the first portion of the shell 105*a* and the first set of parts 120*a* will rotate clockwise. For another example, assume the player rotates the second handle 115*b* counter-clockwise. Then, the second portion of the shell 105*b* and the second set of parts 120*b* will rotate counter-clockwise. For yet another example, assume the player rotates the first handle 115*a* clockwise and the second handle 115*b* counter-clockwise. Then, the first portion of the shell 105*a* and the first set of parts 120*a* will rotate clockwise, while the second portion of the shell 105*b* and the second set of parts 120*b* will rotate counter-clockwise. Alternatively, twisting one or both handles 115*a*, 115*b* simply rotates the respective sets of parts 120*a*, 120*b*, while the shell 105 remains stationary.

In some embodiments, twisting one or both handles 115*a*, 115*b* rotates respective sets of parts 120*a*, 120*b* around a central axis. In some embodiments, twisting one or both handles 115*a*, 115*b* rotates respective sets of parts 120*a*, 120*b* around an equator, such as the ring 110. In some embodiments, twisting one or both handles 115*a*, 115*b* rotates different planes of the three-dimensional pathway structure 120. In some embodiments, twisting one or both handles 115*a*, 115*b* rotates different tracks of the three-dimensional pathway structure 120. In some embodiments, twisting one or both handles 115*a*, 115*b* linearly realigns the tracks, both perpendicular and parallel to the central axis, and/or angularly realigns the tracks. In some embodiments, the central axis is perpendicular to the ring 110.

Twisting Action.

In some embodiments, the three-dimensional pathway structure 120 includes a screw-like structure. The twisting action moves the ball 125 through the screw-like structure. The screw-like structure can be manipulated from outside the shell 105. An external controller provides the twisting action.

Squeezing Action.

In some embodiments, the three-dimensional pathway structure 120 includes a pliers-like structure. The squeezing action is able to open and close the pliers-like structure to push, grab and/or hold the ball 125. The pliers-like structure can be manipulated from outside the shell 105. An external controller provides the squeezing action.

Pulling/Pushing Action.

In some embodiments, the three-dimensional pathway structure 120 includes a gate. The pulling/pushing action is able to open and close the gate. The gate can be manipulated from outside the shell 105. The pulling/pushing action is also able to extend or shorten a pathway. An external controller provides the pulling/pushing action.

Pressing Action.

In some embodiments, the three-dimensional pathway structure 120 includes a button. The pressing action is able to activate the button to further game play. The button can be manipulated from outside the shell 105. An external controller provides the pressing action.

Sliding Action.

In some embodiments, the sliding action is able to move a platform, realign tracks, or both. An external controller provides the sliding action.

Magnets.

In some embodiments, an external controller is an external magnet used to cause internal realignment of tracks by, for example, moving the external magnet along or near the exterior surface of the shell 105.

Figure 4:
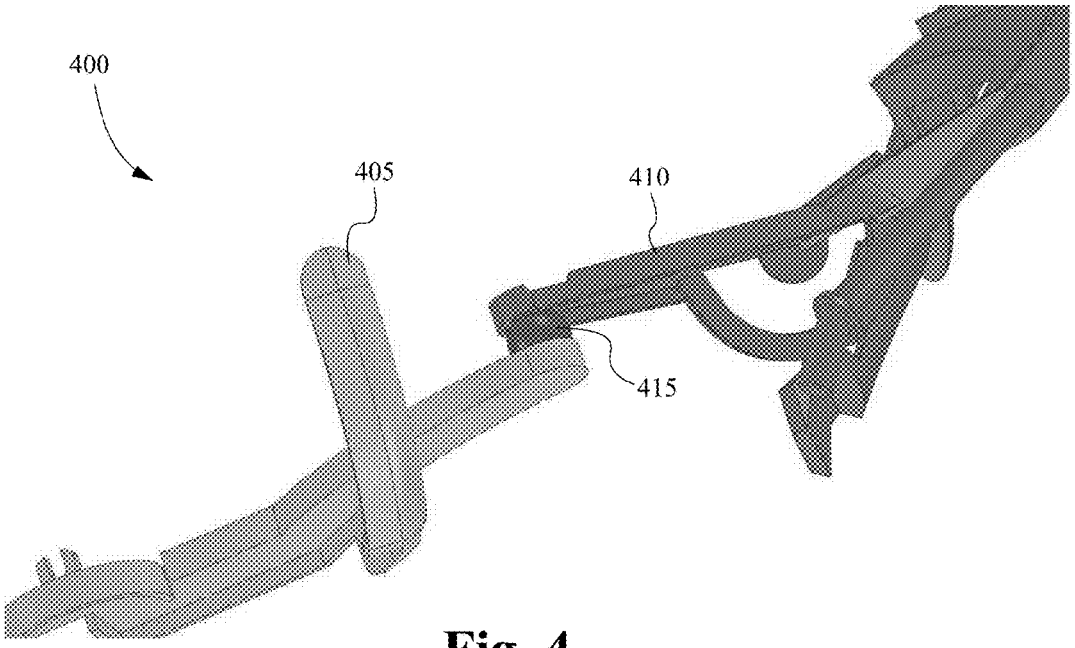
FIG. 4 illustrates an exemplary switch-over mechanism in accordance with the present invention.

Internal Changes Caused By External Manipulations. As discussed above, external manipulations are able to manipulate parts of the three-dimensional pathway structure 120 and cause internal changes to game play features. For example, a switch-over mechanism 400, as illustrated in FIG. 4, allows a ball 415 to go on one path 405 onto another path 410. When two moving tracks 405, 410 are in alignment and sandwich the ball 415, the ball 415 can switch from the first track 405 onto the second track 410 by inversion.

Figure 5A:
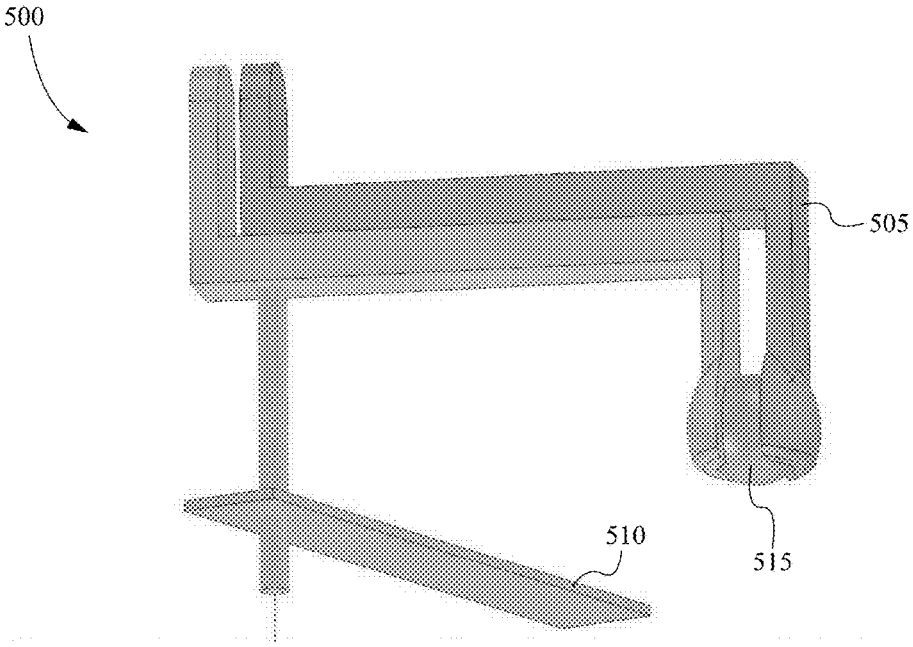
FIGS. 5A-5B illustrate an exemplary pincher mechanism in accordance with the present invention.
Figure 5B:
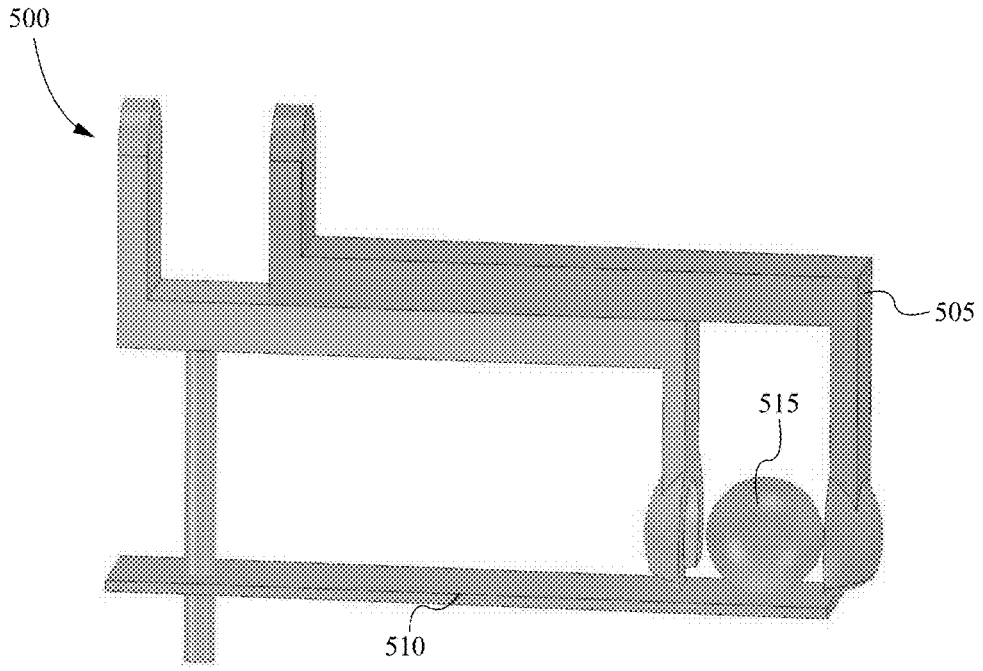

For another example, a grabbing mechanism 500, as illustrated in FIGS. 5A-5B, opens and closes a set of pinchers 505 and has the ability to grab a ball 515 to enable movement of the ball 515 and/or movement of one or more tracks around the ball 515. The grabbing mechanism 500 is able to put the ball 515 on a track 510. Particularly, when the ball 515 is aligned with the pinchers 505, the pinchers 505 open to grab the ball 515 from a track The pinchers 505 can be rotated and opened to drop the ball 515 off on another track 510.

Figure 6A:
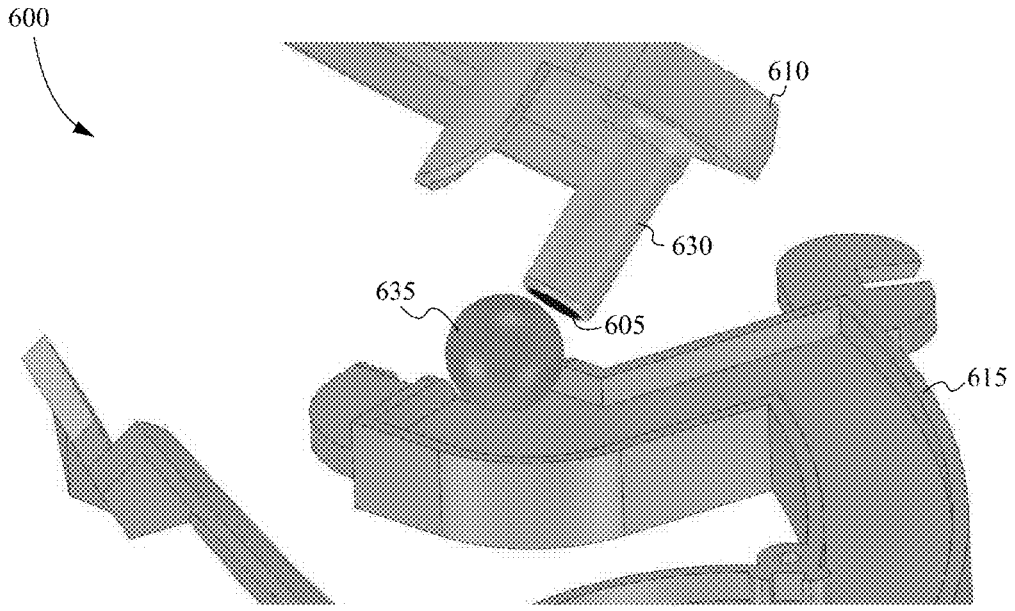
FIGS. 6A-6C illustrate an exemplary magnetic crane in accordance with the present invention.
Figure 6B:
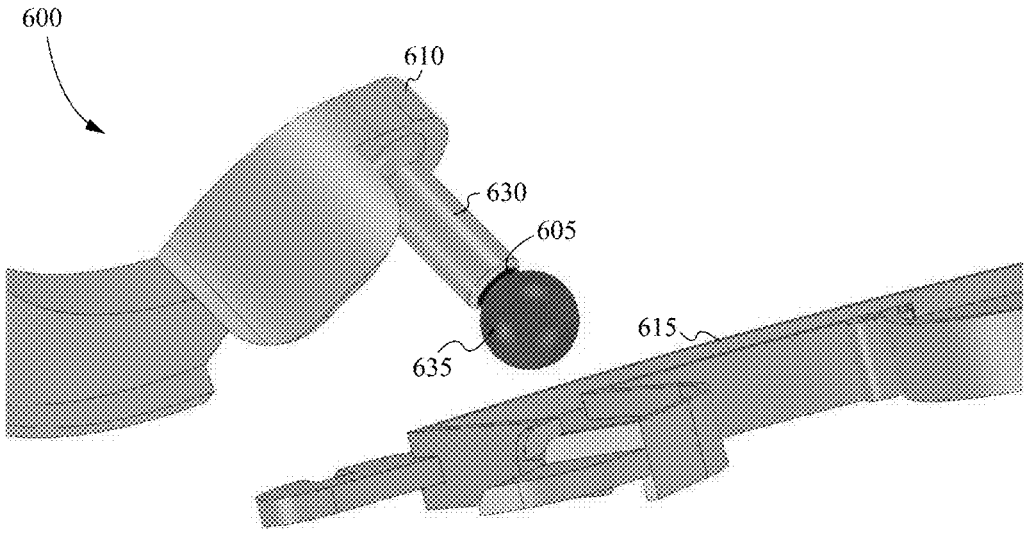
Figure 6C:
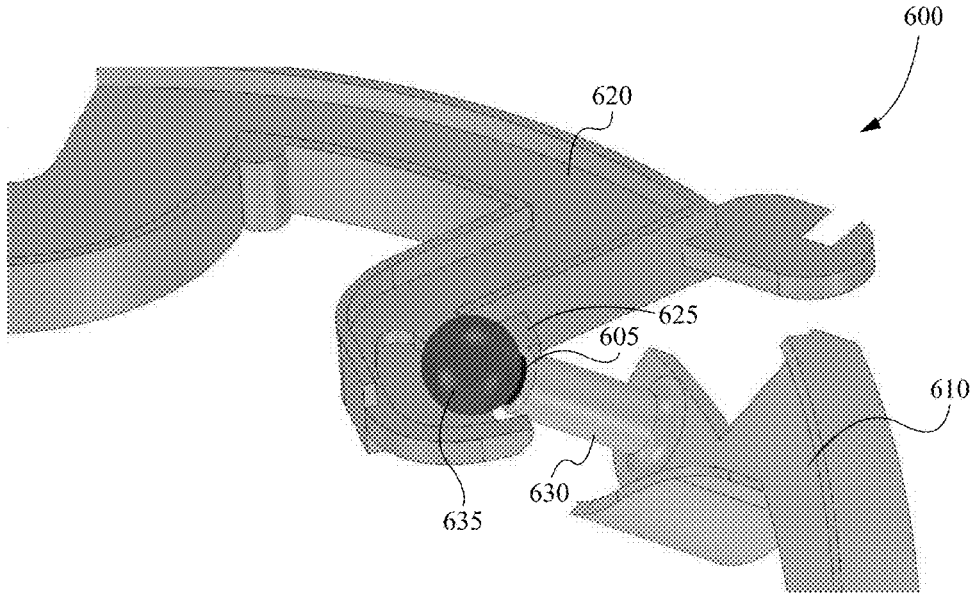

For yet another example, a magnetic crane 600, as illustrated in FIGS. 6A-6C, includes use of a magnetic element 605, such as a magnet, to cause movement of tracks and/or to keep a ball 635 in place, allowing a switch to be contacted or lifted without requiring a mechanical grabber. The magnetic crane 600 includes a stem 630 and an arm 610. Typically, the stem 630 includes the magnetic element 605. The arm 610 is movable to catch the ball 635 from a first track 615 and drop the ball 635 onto a second track 620. The player is able to move an upper section or a lower section of the magnetic crane 600 since both achieve the same result. Only when the track 615 the ball 635 is on is close enough to the stem 630 will the magnet 605 attract the ball 635 (FIG. 6B). The ball 635 can be transferred to the second track 620 using any method. One method could be that the ball 635 is caught by a tooth-like feature 625 protruding vertically from an edge of the track 620 (FIG. 6C). Another method could be that the stem 630 is rotated to one or more fingers that will pull the ball 635 off the stem 630. Typically, the magnet 605 is powerful enough to catch the ball 635 but loose enough so that the ball 635 can be removed from the magnet 605.

Figure 7A:
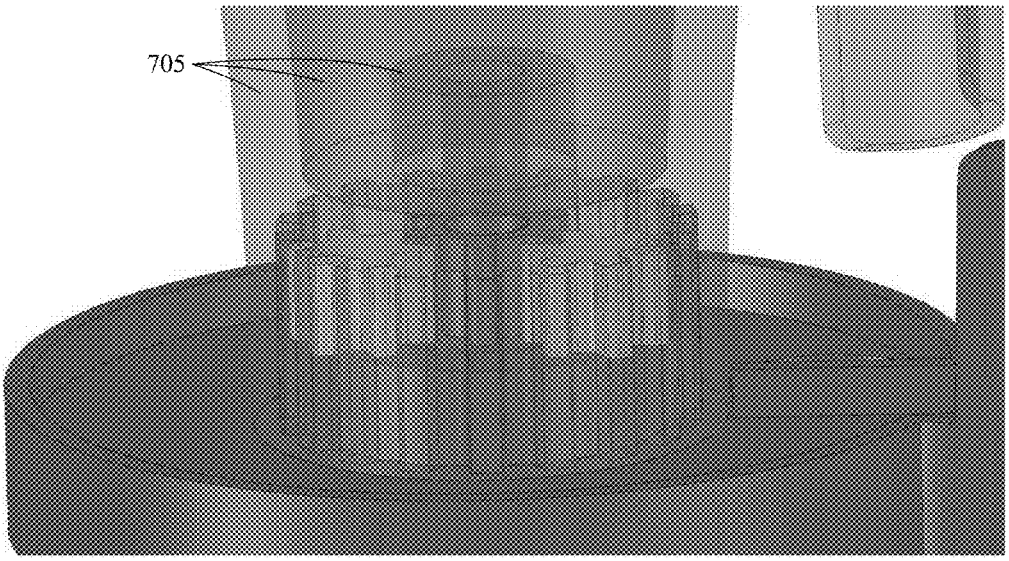
FIGS. 7A-7B illustrate exemplary planetary gears in accordance with the present invention.
Figure 7B:
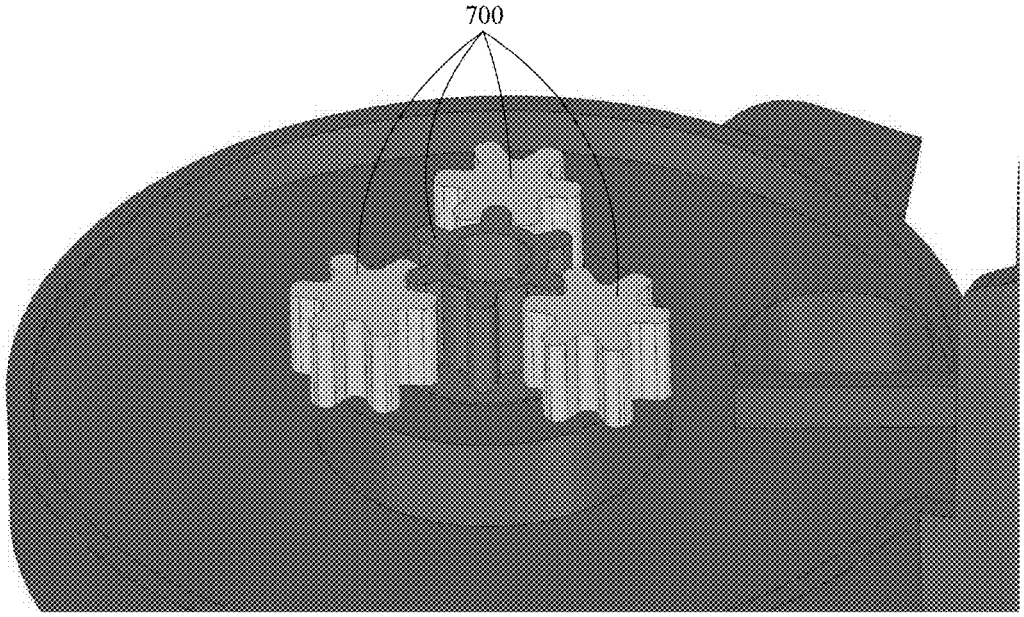

For yet another example, a plurality of planetary gears 700, as illustrated in FIGS. 7A-7B, can rotate different parts 705 of the three-dimensional pathway structure at different speeds relative to each other.

For yet another example, tracks "catch" allowing the ball to go on a different track. Tracks can "catch" by twisting one or more external controllers.

For yet another example, a spring loaded launcher is configured to launch the ball to somewhere within the three-dimensional game.

For yet another example, a gate is configured to open and close from the outside the enclosure.

For yet another example, a magnetically triggered gate is configured to open and close when in alignment with a movable magnet, or magnet attached to a moving track aligned in proximity to the triggered gate.

Internal Changes Caused By Non-External Manipulations. Non-external manipulations are also able to manipulate parts of the three-dimensional pathway structure 120 and cause internal changes to game play features. For example, the three-dimensional game 100 includes an ability to open and close tracks or sections of a track. Several sections of track are unlocked by first completing other sections. This is a form of verification that the player has indeed reached a certain point during game play. Once a track is open, it can be played until passed. This could be accomplished with a mechanism that needs a ball in a place to operate, with different size balls and corresponding track(s) having opening sizes thereon that only allow the right ball having the precise size to pass, with mechanical triggers released by a moving ball, or with a combination thereof.

For another example, the three-dimensional game 100 includes an ability to save progress (e.g., game state) and come back to it by locking levels such as by using one or more balls as described above.

For yet another example, a corkscrew mechanism transports a ball around the three-dimensional pathway structure 120. In some embodiments, the corkscrew mechanism includes multiple pathways therein. Once the ball enters an opening to get inside, the ball travels on the corkscrew to one of multiple exits. Each exit allows the ball to end up at a different location in the three-dimensional pathway structure 120.

Game Design Elements

Figure 8:
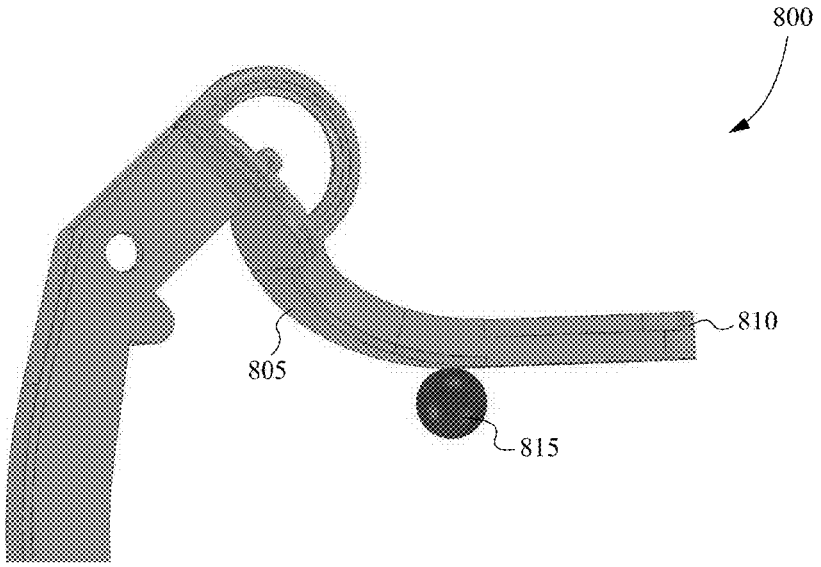
FIG. 8 illustrate an exemplary magnetic track section in accordance with the present invention.

Magnetic Track Section. FIG. 8 illustrates an exemplary magnetic track section 800 in accordance with the present invention. A die cut soft magnet 805 coupled to at least a portion of a track 810 allows for upside-down play. In particular, a ball 815 hangs from the magnetic track section 800, which is coupled with the magnet 805. If the player tries to "ride" the ball 815 on the surface, the ball 815 may not stay on the track 810 because there are no railings and/or the track 810 may be curved. During game play, the player needs to turn the track 810 upside down such that the ball 815 hangs from the track 810. This track 810 gives the illusion that the ball 815 cannot go across the track 810, especially if the track 810 is painted the same color as other tracks. Once the ball rolls to an end of the magnetic track section 800 and with enough momentum, the ball 815 falls, for example, into a cup or onto another track. The player will need to finesse the amount of energy required to get the ball off the magnetic track section 800.

Saving/Locking Feature. A saving/locking feature is configured to save progress of game play by locking levels such as by using one or more balls, discussed above in regards to Internal Changes Caused By Non-External Manipulations.

Shell. At least a portion of the shell can be configured as a part of a track. Typically, a ball cannot "fall off" a tube, which can form a part of the three-dimensional pathway structure. Another way to prevent a ball from falling off a track is by using the shell itself. If a branch is close enough to the shell, the ball cannot get in between the branch and the shell. However, if the branch is in the right location, the ball can get trapped between it and the shell, allowing the ball to travel without falling off.

Multiple Balls. Each ball can have a different size and/or color and be made of different material, such a rubber, plastic or metal. Ball material properties include, but are not limited to, magnetic, magnetically attractive, non-magnetic, heavy, light, bouncy, and rigid.

Different balls can be used for different kinds of transfers across tracks. For example, a non-magnetic ball can only go on certain routes. But, a magnetic ball can pass over a magnetically attractive track piece. For another example, a heavy ball can tip over a cantilever. But, a lighter ball will just pass over it.

Figure 9A:
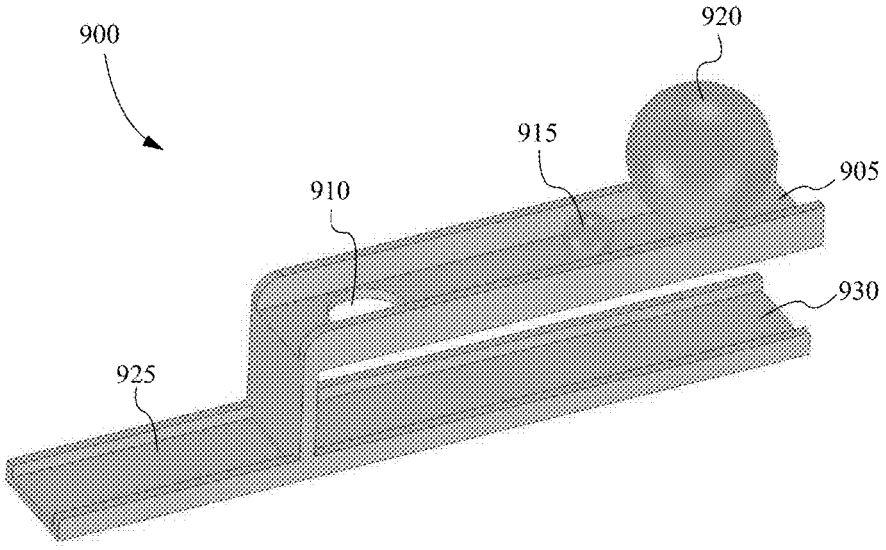
FIGS. 9A-9B illustrate an exemplary 2-ball course structure in accordance with the present invention.
Figure 9B:
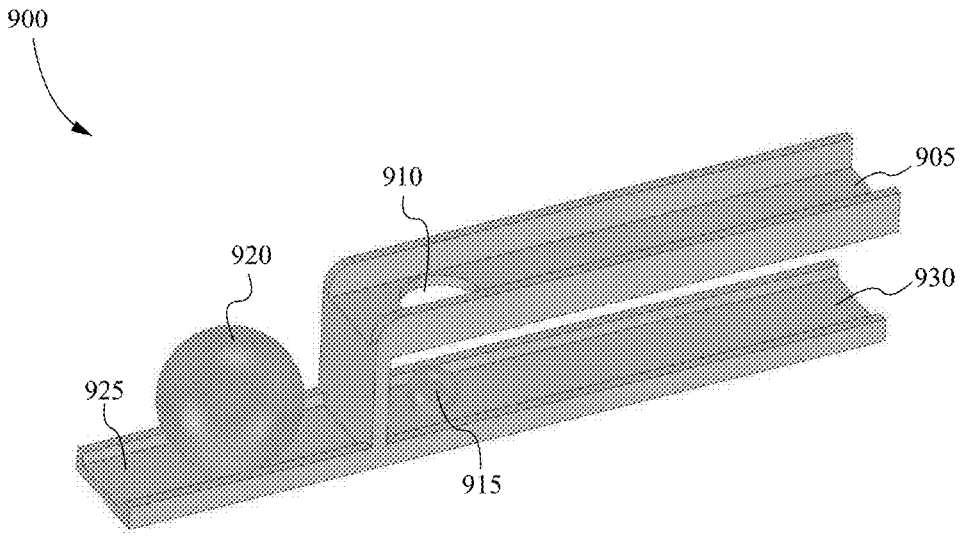

FIGS. 9A-9B illustrate another exemplary transfer 900 in accordance with the present invention. A path 905 is configured to allow one or more balls to roll along it. The path 905 has a hole 910 formed thereon. If a ball is of the wrong size, such as the ball 920 (e.g., bigger than the hole size), the ball 920 will not drop into the hole 910 but just roll along the path 905 until another path 925. However, if a ball is of the right size, such a the ball 915, then the ball 915 drops into the hole 910 onto another path 930.

Figure 10A:
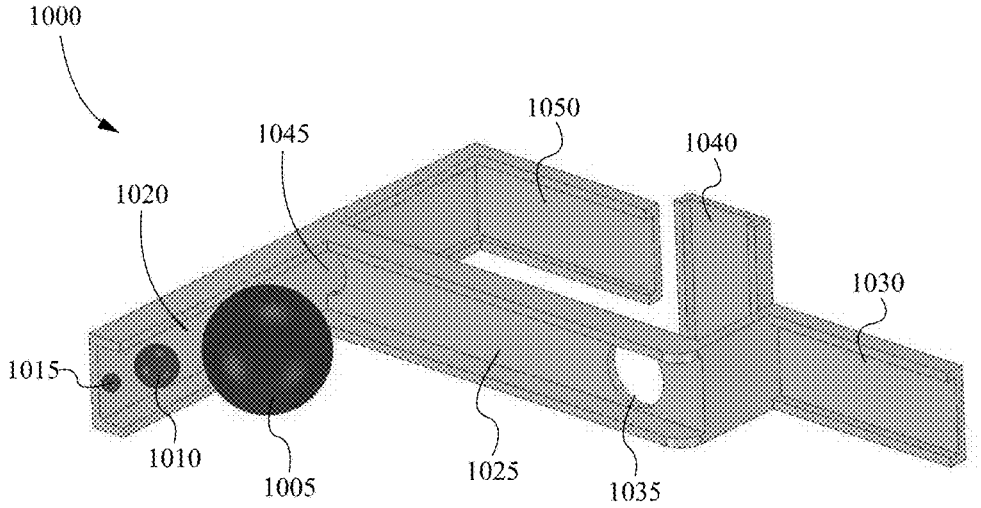
FIGS. 10A-10B illustrate an exemplary 3-ball course structure in accordance with the present invention.
Figure 10B:
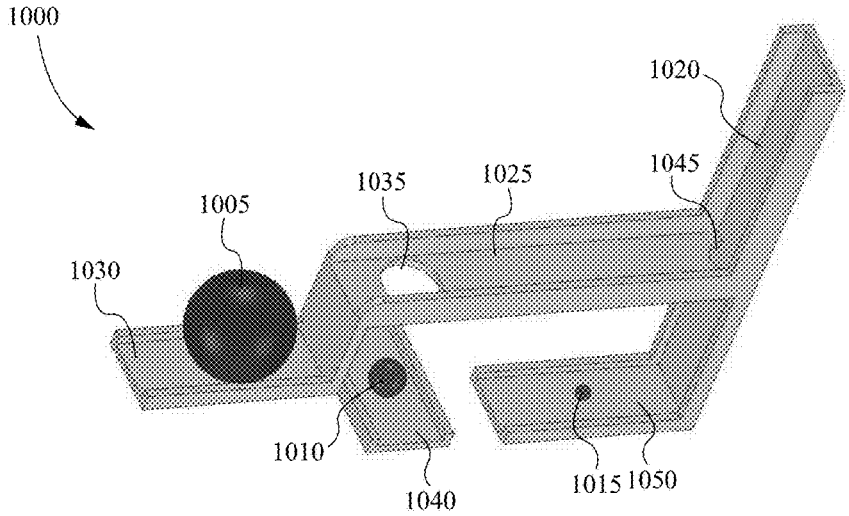

FIGS. 10A-10B illustrate another exemplary transfer 1000 in accordance with the present invention. A first ball 1005 rolls on a first path 1020 onto a second path 1025 to go off an edge of the second path 1025 onto a third path 1030 below it. Compare to a second (smaller) ball 1010 which rolls on the first path 1020 onto the second path 1025 but falls through a hole 1035 formed thereon onto a fourth path 1040. Compare to a third (smallest) ball 1015 which starts on the first path 1020 and falls through a hole 1045 formed thereon onto a fifth path 1050.

In some embodiments, the three-dimensional game has verifiable points along the game to prevent cheating. For example, a first ball can lock in place while releasing a second ball.

Figure 11:
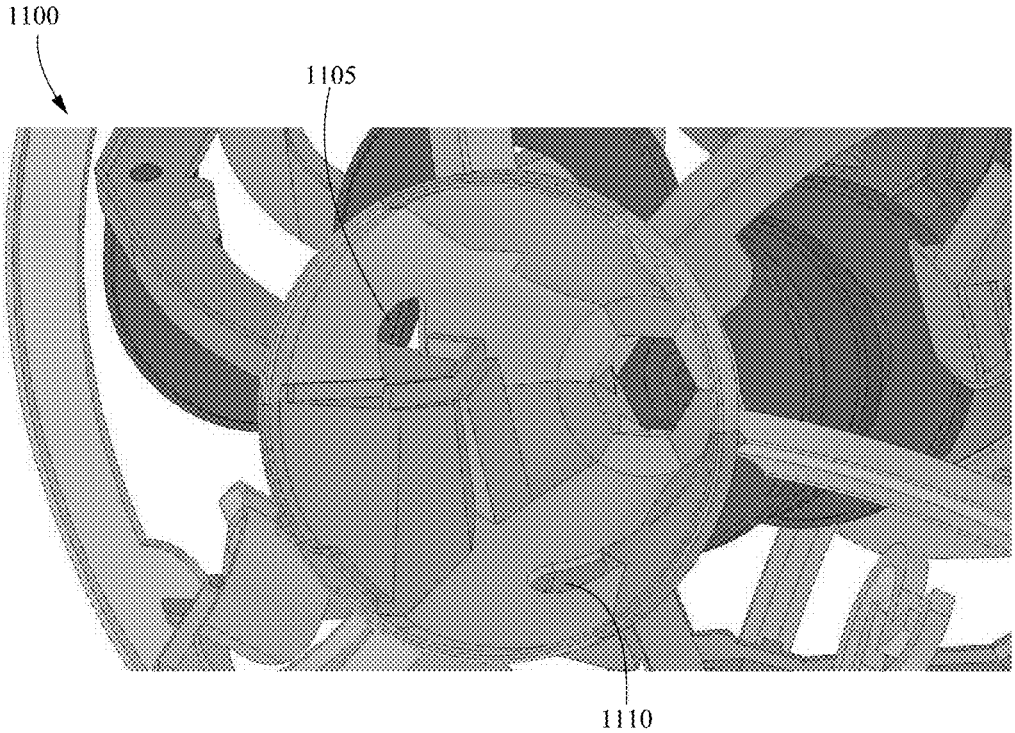
FIG. 11 illustrates an exemplary first shaft in accordance with the present invention.

Handles. Each handle includes a shaft that extends into the housing. The shafts are used during game play. FIG. 11 illustrates a shaft 1100 of a first handle in accordance with the present invention. In the shaft 1100 of the first handle, a ball enters the shaft from a hole 1105 and is loose within the shaft 1100 until the ball exits out another hole 1110 onto a path connecting therefrom.

Figure 12:
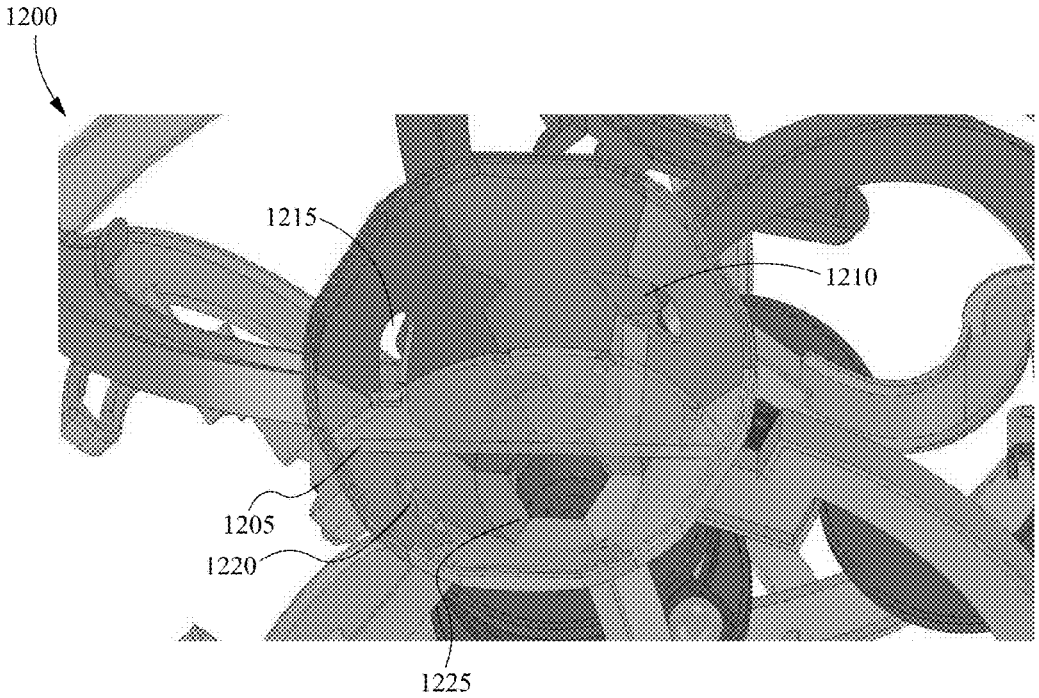
FIG. 12 illustrates an exemplary second shaft in accordance with the present invention.

FIG. 12 illustrates a shaft 1200 of a second handle in accordance with the present invention. In the shaft 1200 of the second handle, there are two pathways: one above a shelf 1205 and one below the shelf 1205. In regards to the one above the shelf 1205, a ball comes in one hole 1210 and out another hole 1215. In regards to the one below the shelf 1205, a ball comes in through a hole 1220 and falls onto a ledge 1220 located at the bottom of the shaft 1200. Upon rotation, the ball goes through the shaft 1200 and out onto another pathway.

In some embodiments, the shape of the three-dimensional game appears to be twisty/spiral. The handles can enhance the twisty/spiral look and feel. In some embodiments, a part of the handles can be used as a stand to set the three-dimensional game down and/or to display the three-dimensional game.

Pedestal. A pedestal, such as that illustrated in FIGS. 2 and 3, also allows the player to set the three-dimensional game down, display the three-dimensional game, and/or keep the three-dimensional game on the pedestal to save progress.

External Rings. In some embodiments, an external ring can be perpendicular to the central axis. Alternatively, an external ring is not perpendicular to the central axis. Instead, the external ring is slanted. For example, the external ring can be oriented to the tilt of an internal ring. In some embodiments, the internal ring can be a pathway that a ball rides on from one of the branches only when the branch is oriented in the right position, allowing the ball to transfer from the branch to the internal ring. In some embodiments, the three-dimensional game does not have any external rings.

Shortcuts. In some embodiments, the three-dimensional game employ shortcuts to allow the player to move a ball from a first area to a third area, bypassing a second area. In some embodiments, the shortcuts are more challenging than the rest of the game.

Electronic Components. In some embodiments, sensors are located within the housing to detect movement of a ball, to learn the player's skill level, and/or to activate/deactivate portions of the pathway structure. In some embodiments, a built-in clock or timer allows the player to race against during game play.

Figure 13:
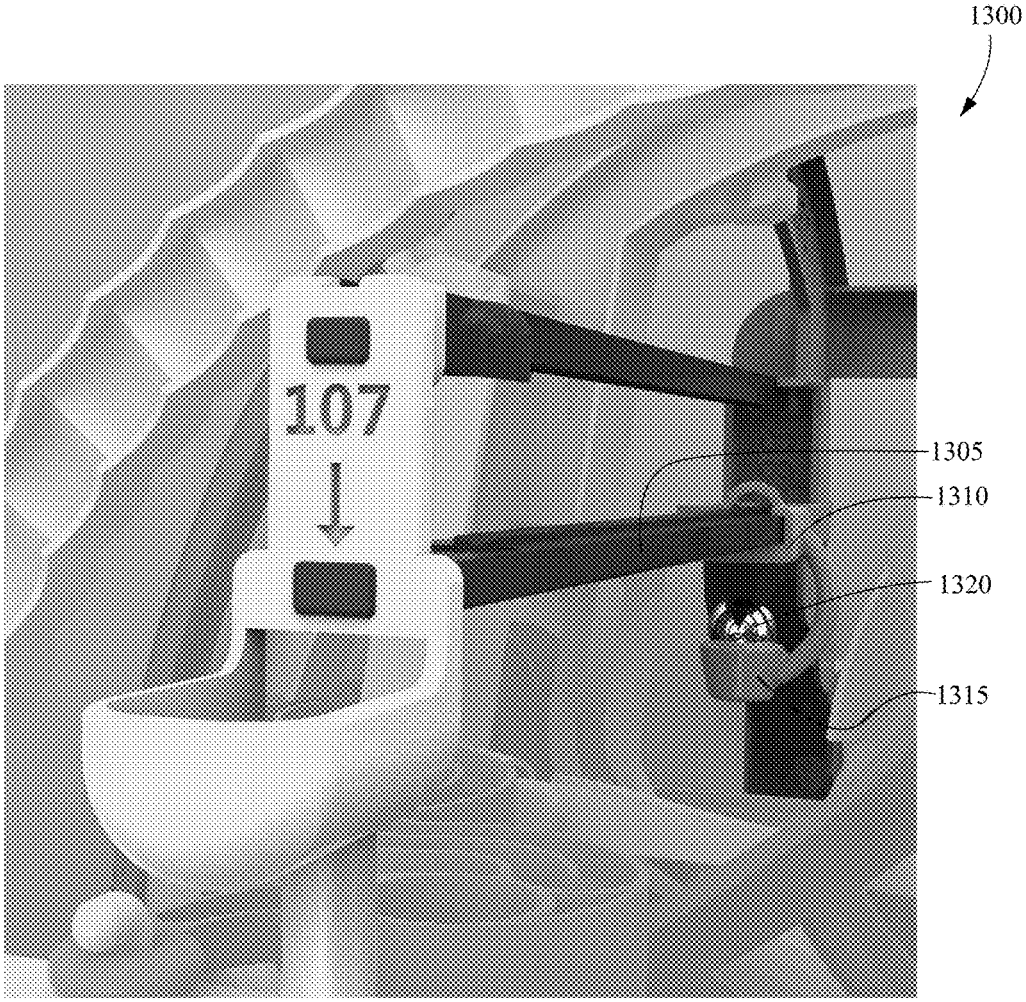
FIG. 13 illustrates an exemplary gantry with trolley car in accordance with the present invention.

Gantry With Moving Trolley Car. FIG. 13 illustrates an exemplary gantry 1300 in accordance with the present invention. A trolley 1310 is configured to carry and transport a ball 1320 in a cup 1315 along a railing 1305. The railing 1305 guides the trolley 1310 to a location. At the location, the ball 1320 can be disembarked by tipping motion. In some embodiments, a side of the railing 1305 or a bottom of the cup 1315 can be used during game play.

Figure 14:
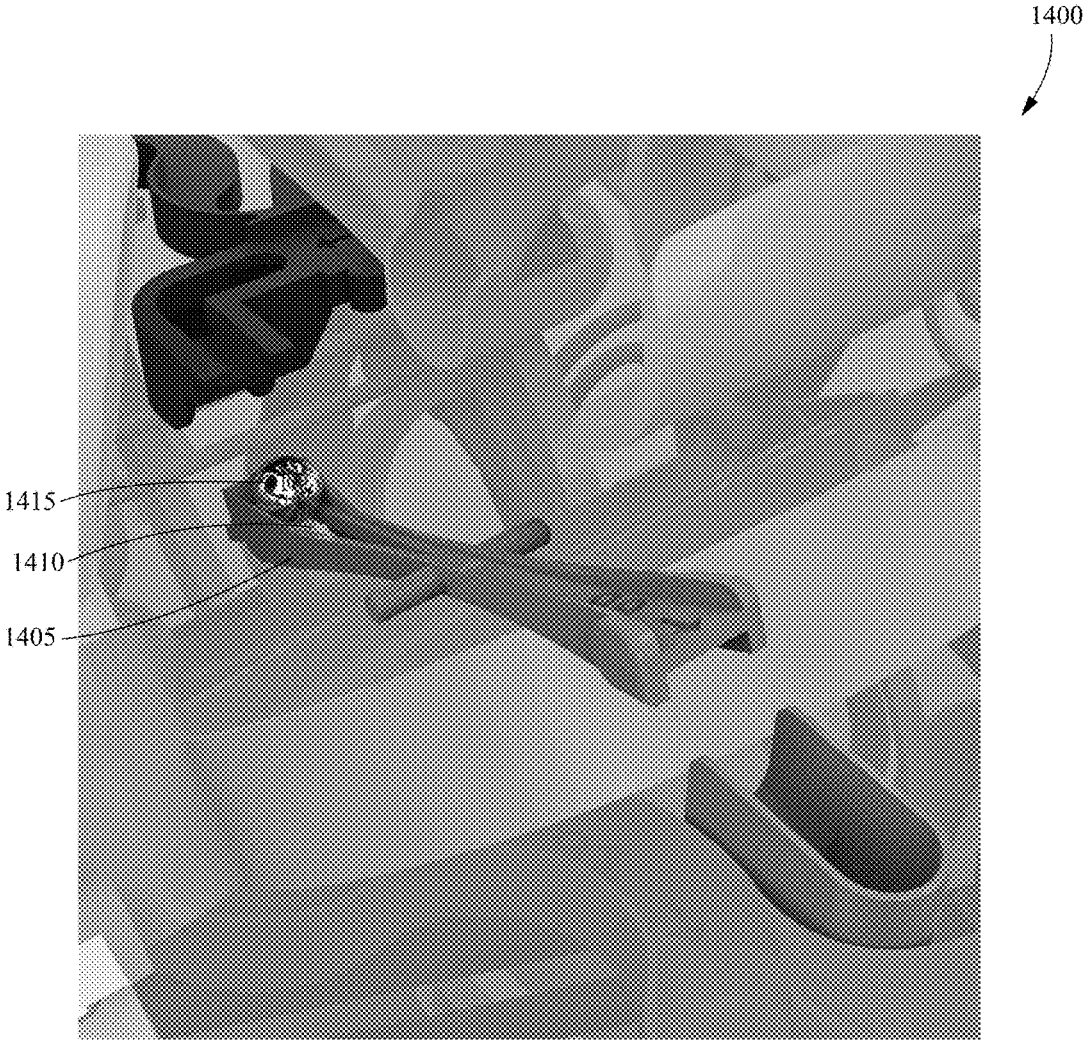
FIG. 14 illustrates an exemplary teeter totter in accordance with the present invention.

Teeter Totter. FIG. 14 illustrates an exemplary teeter totter 1400 in accordance with the present invention. In some embodiments, there are at least two uses of the teeter totter 1400. In regards to a first use, a ball 1415 rolls from one end across a seesaw 1405 to the other end. The seesaw 1405 tips, allowing the ball 1415 to roll off the seesaw 1405. In regards to another use, the ball 1415 catches onto the seesaw 1405. When the ball 1415 starts to roll across a portion of the seesaw 1405 in one direction, the seesaw 1405 tips in that direction, allowing the ball 1415 to drop off from the seesaw 1405. In some embodiments, sides of the seesaw 1405 can also be used during game play to transport the ball 1415 in a rotational direction.

Figure 15:
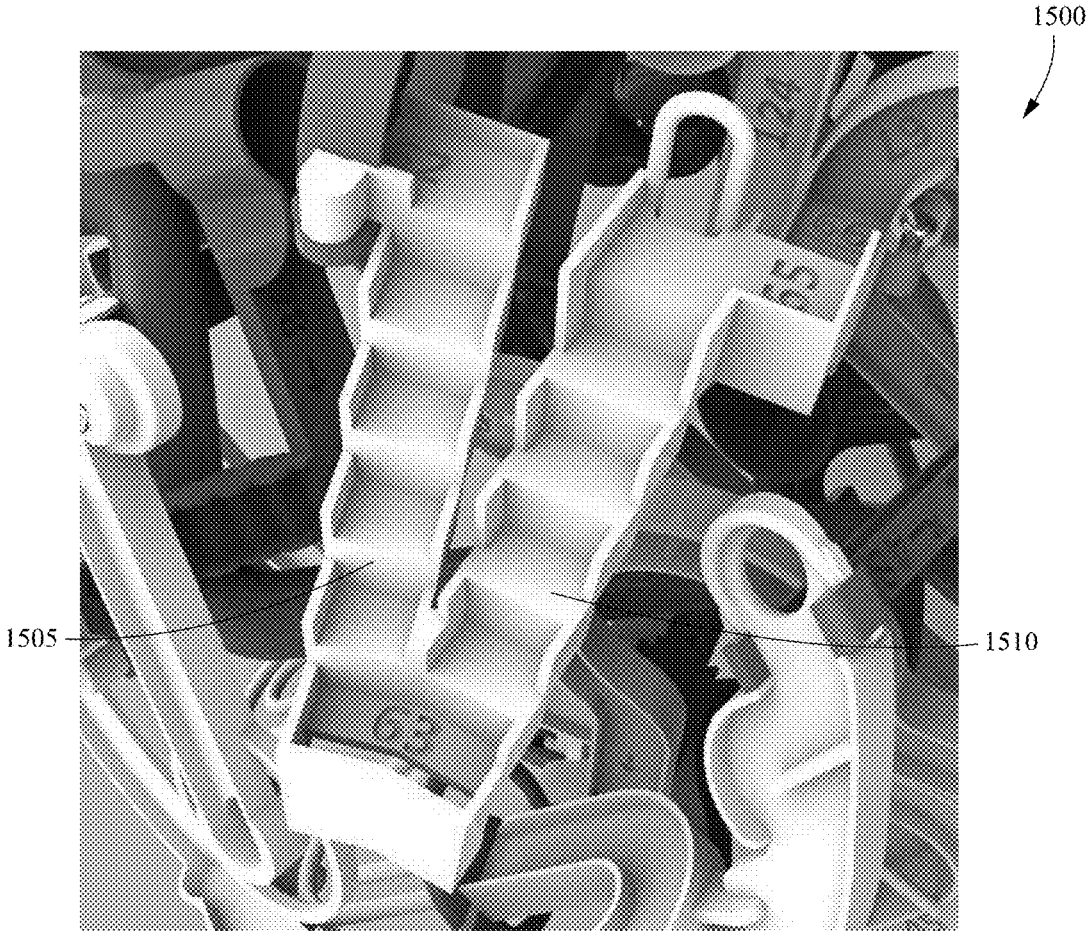
FIG. 15 illustrates an exemplary four way staircase in accordance with the present invention.

Four Way Staircase. FIG. 15 illustrates an exemplary four way staircase 1500 in accordance with the present invention. Typically, there is usually a rise and a run to a traditional staircase. However, the rise and run of the four way staircase 1500 are interchangeable. In particular, the rise 1505 on a first side becomes the run on a second side, and the run 1510 on the first side becomes the rise on the second side. As illustrated, the staircase 1500 is split to give it a more visual challenge. But, the staircase can be meshed with a rail in between. In some embodiments, a ball can traverse the sides of the staircase 1500 during game play.

Figure 16:
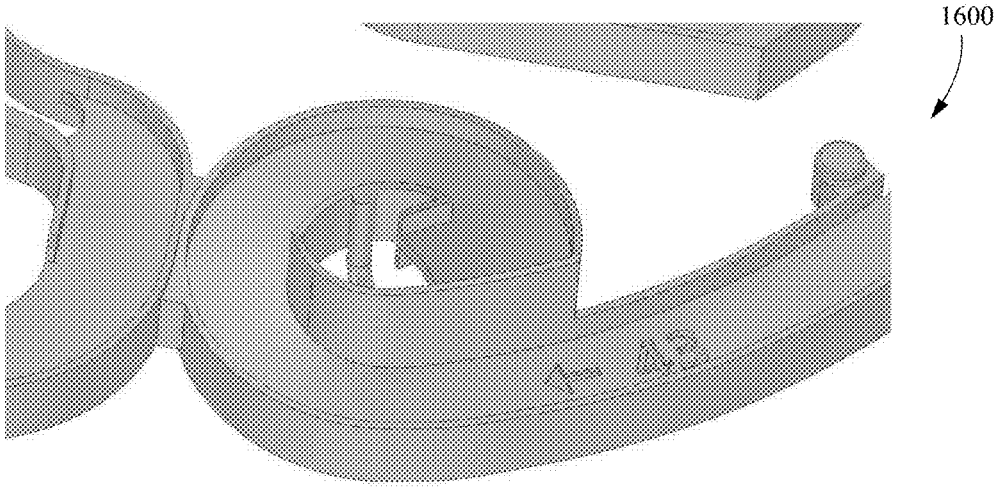
FIG. 16 illustrates an exemplary upward spiral in accordance with the present invention.

Upward Spiral. FIG. 16 illustrates an exemplary upward spiral 1600 in accordance with the present invention. Typically, the action of moving a ball along the upward spiral 1600 feels resistant. In some embodiments, a backside of the upward spiral 1600 can be used during game play.

Figure 17:
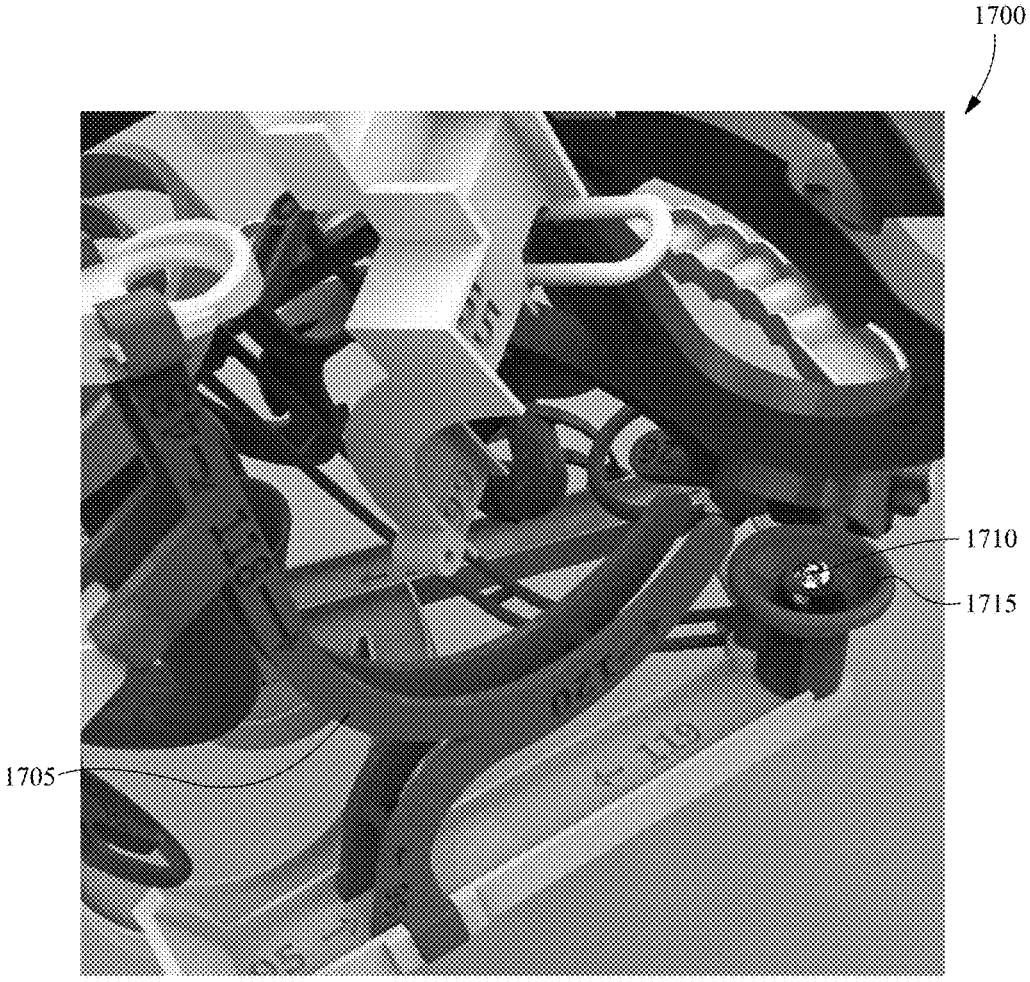
FIG. 17 illustrates an exemplary split track barrel roll in accordance with the present invention.

Split Track Barrel Roll. FIG. 17 illustrates an exemplary split track barrel roll 1700 in accordance with the present invention. The split track barrel roll 1700 includes a complex curve and a split rail 1705. A ball 1710 typically rides on the rail 1705. "Riding" on the rail requires compound rotational movement transport the ball 1710 (simultaneous movement of X, Y, and Z axes). In other words, moving the ball 1710 through different planes in space requires compound turning of the three-dimensional game, instead of a planar rotation. The ball 1710 typically leaves the rail 1705 into a barrel 1715.

Figure 18:
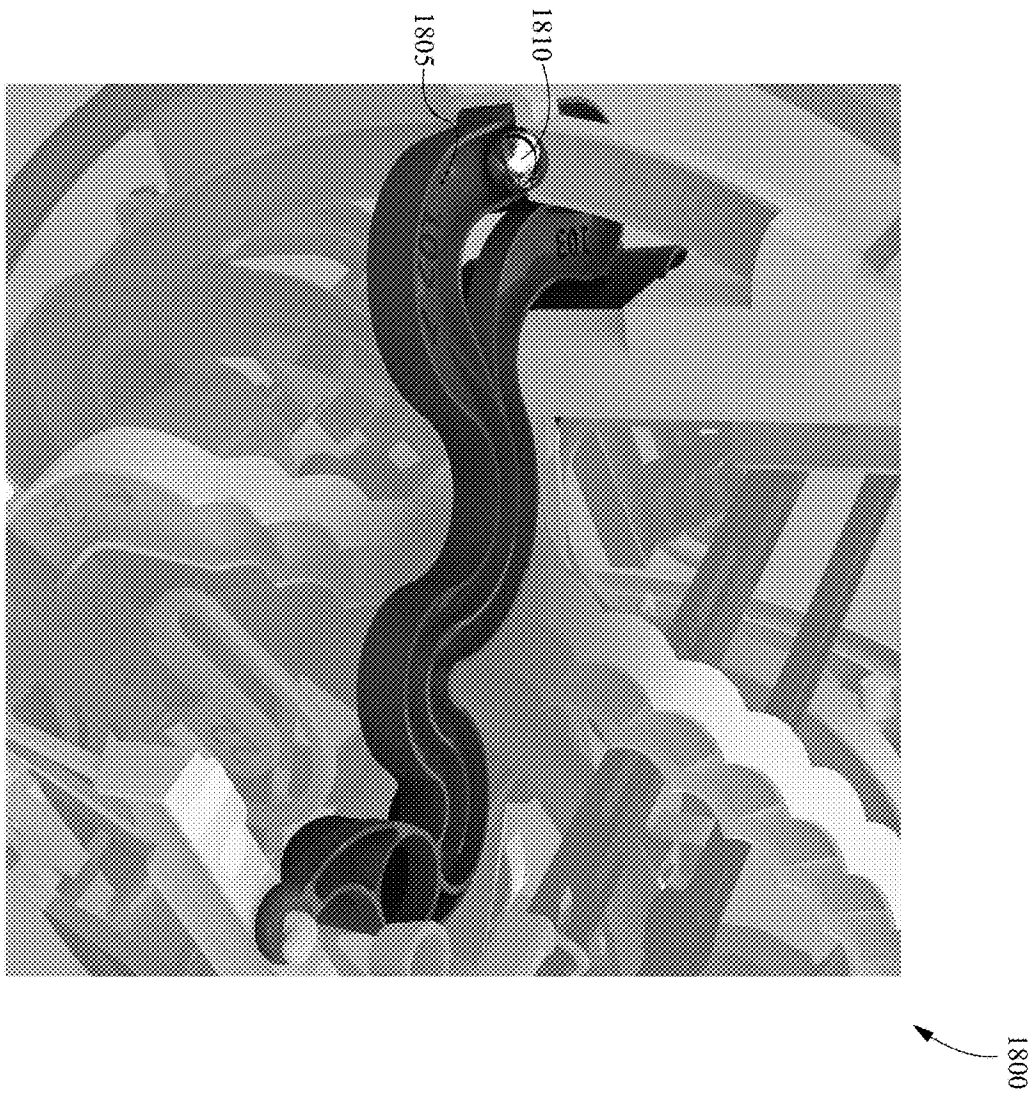
FIG. 18 illustrates an exemplary double sided path in accordance with the present invention.

Double Sided Path. FIG. 18 illustrates an exemplary double sided path 1800 in accordance with the present invention. On one side is a single pathway. On the other side is a dual pathway 1805. At a certain location of the dual pathway 1805, a ball 1810 rides on rails instead of a pathway itself, which changes the speed of the ball 1810. Width of a pathway can change or vary to speed up or slow down the ball 1810.

Figure 19A:
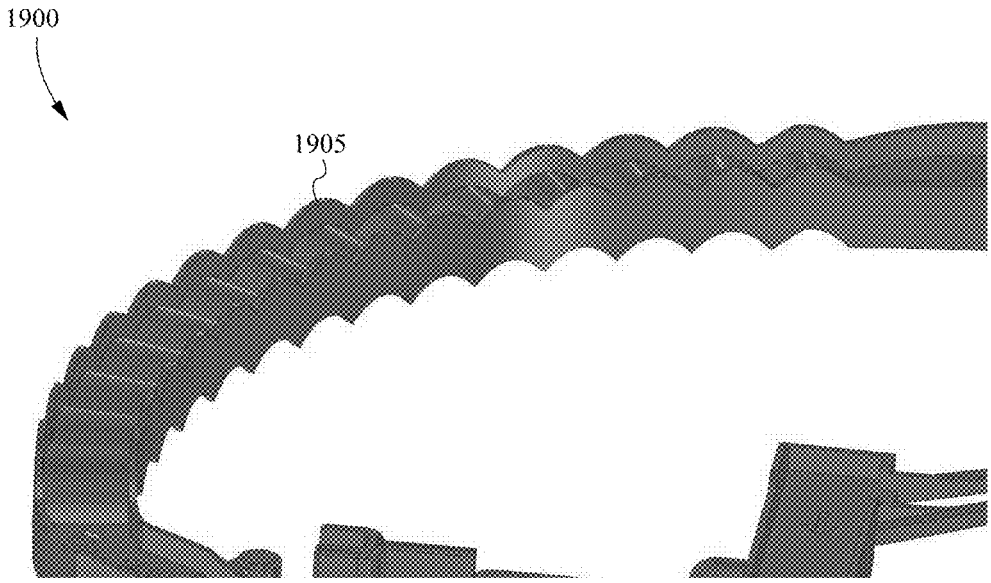
FIGS. 19A-19B illustrate an exemplary corrugated path in accordance with the present invention.
Figure 19B:
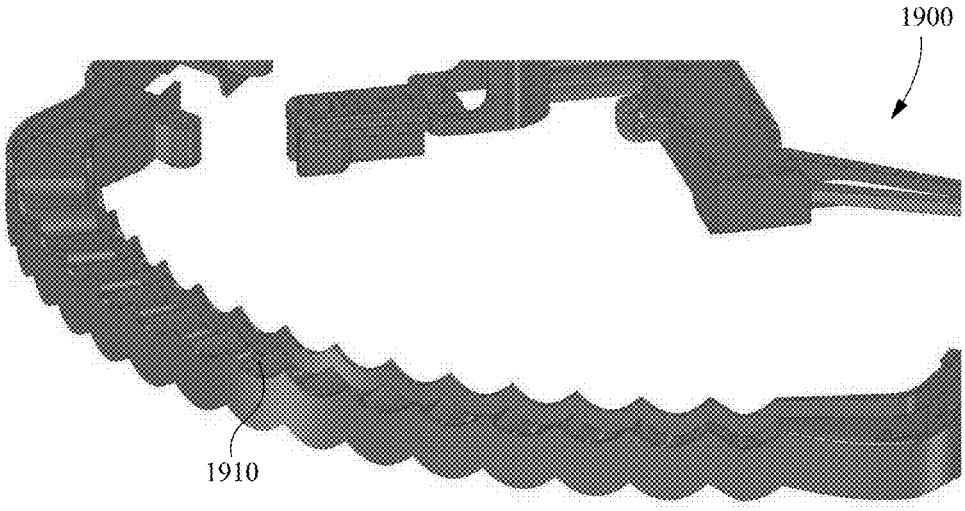

Corrugated Path. FIGS. 19A-19B illustrate a corrugated path 1900 in accordance with the present invention. In some embodiments, the path 1900 includes scalloped parts for creating sound and motion effects. For example, bumps 1905 on one side create soft sound and bumpy motion, and peaks 1910 on other side create hard sound and jarring motion. The scalloped parts can be of the same width or of different widths. In some embodiments, railing on one side of a path can be higher than the rail on the other side so that a ball travels at an angle.

Momentum. Momentum is required for completing some elements. This is a game play concept that requires not just realignment but momentum created by shaking, shifting, jolting or bumping a ball to move the ball in certain ways.

Jumps. A ball can leave a track in an upward direction rather than just a drop off. Alternatively or in addition to, the ball can leave a track on its own force and return back on the same track, instead of a drop off or dropping into a bucket. Alternatively or in addition to, the ball can jump from one side of the housing to the other side of the housing.

Alternative Embodiments

It is contemplated that an embodiment of the three-dimensional game is an electronic game. In some embodiments, the housing is the input device that manipulates a digital version of the game shown on a display.

While the invention has been described with reference to numerous specific details, one of ordinary skill in the art will recognize that the invention can be embodied in other specific forms without departing from the spirit of the invention. Thus, one of ordinary skill in the art will understand that the invention is not to be limited by the foregoing illustrative details, but rather is to be defined by the appended claims.

We claim:

1. A game comprising:

a shell;

an internal three-dimensional pathway structure enclosed within the shell and includes a plurality of parts, wherein a first pathway is formed by a first spatial alignment sequence of a plurality of the parts;

one or more external controllers coupled to the shell and the internal three-dimensional pathway structure, wherein by manipulating one or more portions of the controllers accessible outside of the shell, at least one of the parts is moved with respect to another one of the parts to achieve a desired result thereby creating a second pathway formed by a second spatial alignment sequence of a plurality of the parts, wherein the second spatial alignment sequence is different than the first spatial alignment sequence;

at least one game state; and a plurality of levels, wherein the at least one game state is saved by locking a corresponding level.

2. The game of claim 1, wherein the desired result is to at least one of create new pathways and align pathways to enable completion of a game play.

3. The game of claim 2, wherein at least one pathway has a dual-sided track.

4. The game of claim 1, wherein an internal change to the three-dimensional pathway structure is caused by one or more external manipulations.

5. The game of claim 1, wherein the parts are manipulated via at least one of a rotational action, a twisting action, a squeezing action, a pulling/pushing action, a pressing action, a sliding action, and use of magnets.

6. The game of claim 1, wherein the internal three-dimensional pathway structure includes parts that are non-externally manipulable.

7. The game of claim 1, wherein the three-dimensional structure includes a path when the three-dimensional structure is manipulated by a player to be in a first configuration and includes different path when the three-dimensional structure is manipulated by the player to be in a second configuration.

8. The game of claim 1, wherein the three-dimensional structure includes variable paths.

9. The game of claim 8, wherein the variable paths are created when parts of the three-dimensional pathway structure are manipulated.

10. The game of claim 1, further comprising a first handle coupled with a first portion of the shell and a second handle coupled with a second portion of the shell, wherein each of the first handle and the second handle is configured to manipulate at least a part of the three-dimensional structure.

11. The game of claim 1, wherein the one or more external controllers provide twisting actions.

12. The game of claim 11, wherein the twisting actions include at least one of rotating a plurality of tracks concurrently and rotating a single track.

13. The game of claim 1, wherein the one or more external controllers provide non-twisting actions.

14. The game of claim 13, wherein the non-twisting actions include at least one of squeezing, pulling, pressing and sliding at least a portion of the one or more external controllers.

15. The game of claim 1, wherein the corresponding level is locked by completing a portion of the game.

16. The game of claim 1, wherein the three-dimensional pathway structure includes parts that are manipulable to achieve the at least one game state.

17. The game of claim 1, wherein the at least one game state is achieved by moving the game to thereby orient gravity to an at least one mobile element such that the at least one mobile element moves through the three-dimensional pathway structure.

18. The game of claim 1, further comprising at least one ball, wherein a player continuously moves the game to orient gravity to the at least one ball such that at least one ball moves through the three-dimensional structure.

19. A game comprising:

a shell;

an internal three-dimensional pathway structure enclosed within the shell and includes a plurality of parts;

one or more external controllers coupled to the shell and the internal three-dimensional pathway structure, wherein one or more of the parts are able to be moved with respect to the shell by manipulating one or more portions of the controllers accessible outside of the shell to achieve a desired result, wherein the internal three-dimensional pathway structure is suspended within the air by the controllers within the shell such that the internal three-dimensional pathway structure does not contact the inside of the shell;

at least one game state; and a plurality of levels, wherein the at least one game state is saved by locking a corresponding level, wherein the at least one game state is achieved by moving the game to thereby orient gravity to an at least one mobile element such that the at least one mobile element moves through the three-dimensional pathway structure.

20. A game comprising:

a ball;

a shell;

an internal three-dimensional pathway structure enclosed within the shell and including a first part, a second part and a third part; and one or more external controllers coupled to the shell and the internal three-dimensional pathway structure;

wherein by manipulating the controllers in a first manner, the first part is moved adjacent to the second part thereby forming a first pathway traversable by the ball from the first part directly to the second part, and further wherein manipulating the controllers in a second manner, the first part is moved away from the second part and adjacent to the third part thereby eliminating the first path and forming a second pathway traversable by the ball from the first part directly to the third part.

* * * * *